US011231151B1

(12) United States Patent
Liu et al.

(10) Patent No.: US 11,231,151 B1
(45) Date of Patent: Jan. 25, 2022

(54) SMART NET LIGHT STRINGS

(71) Applicant: SHENZHEN EKOLA LIGHTING TECHNOLOGY CO., LTD., Shenzhen (CN)

(72) Inventors: Jie Liu, Shenzhen (CN); Jianbo Chen, Shenzhen (CN); Dingbo Xie, Shenzhen (CN); Bingbin Jia, Shenzhen (CN)

(73) Assignee: SHENZHEN EKOLA LIGHIING TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 17/340,072

(22) Filed: Jun. 6, 2021

Related U.S. Application Data

(63) Continuation of application No. PCT/CN2021/087886, filed on Apr. 16, 2021.

(51) Int. Cl.

| | |
|---|---|
| ***F21S 4/15*** | (2016.01) |
| ***F21S 4/22*** | (2016.01) |
| ***F21V 3/06*** | (2018.01) |
| ***H05B 45/34*** | (2020.01) |
| ***F21V 23/00*** | (2015.01) |
| ***F21V 23/06*** | (2006.01) |
| *F21Y 115/10* | (2016.01) |

(52) U.S. Cl.
CPC . *F21S 4/15* (2016.01); *F21S 4/22* (2016.01); *F21V 3/062* (2018.02); *F21V 23/001* (2013.01); *F21V 23/06* (2013.01); *H05B 45/34* (2020.01); *F21Y 2115/10* (2016.08)

(58) Field of Classification Search
CPC .... F21Y 2115/10; F21V 23/03; F21V 23/001; F21V 3/062; H05B 45/34; F21S 4/15; F21S 4/22
See application file for complete search history.

(56) References Cited

U.S. PATENT DOCUMENTS

| | | | | |
|---|---|---|---|---|
| 6,634,766 | B1 * | 10/2003 | Gordon | F21S 4/10 362/239 |
| 10,184,654 | B1 * | 1/2019 | Chen | F21S 4/10 |
| 2006/0039142 | A1 * | 2/2006 | Temple | G09F 9/33 362/231 |
| 2015/0078000 | A1 * | 3/2015 | Chen | F21V 23/001 362/249.16 |
| 2020/0232614 | A1 * | 7/2020 | Hsu | F21S 9/02 |

FOREIGN PATENT DOCUMENTS

CN 108134273 A * 6/2018

* cited by examiner

*Primary Examiner* — Anabel Ton

(57) ABSTRACT

The present disclosure provides smart net light strings. The smart light strings include a limit guiding rail. A matched guiding rail is disposed on a top portion of the limit guiding rail. A top portion of the matched guiding rail is clamped with connecting plates. Locking rods are connected to the top portion of the matched guiding rail through threads. Positioning sleeves are inserted into an interior of the limit guiding rail, and the positioning sleeves are clamped with the limit guiding rail. A control unit is disposed in the interior of the limit guiding rail. An electrical wire passes through an interior of each positioning sleeve. Lampshades are disposed on an outer surface of each electrical wire. An interior of each lampshade is filled with transparent glue. A lamp bead mounting groove is disposed on a surface of each lampshade.

9 Claims, 5 Drawing Sheets

SMART NET LIGHT STRINGS

TECHNICAL FIELD

The present disclosure relates to a field of smart lamp technology, and in particular to smart net light strings.

BACKGROUND

Smart lamp beads refer to lamp beads that realize remote centralized control and management of lamp beads by applying advanced, efficient and reliable power line carrier communication technology and wireless GPRS/CDMA communication technology, etc.

Smart lamp beads are an important part of smart city. It applies urban sensors, power line carriers/ZigBee communication technology and wireless GPRS/CDMA communication technology, etc., to connect the lamp beads in the city to form the Internet of Things, and realize remote centralized control of lamp beads. Light strings formed in series by electrical wires, are more suitable for decoration and brightization of outdoor park, outdoor lawn, outdoor trees, indoor entertainment venues, and home.

However, the light beads connected in series are weak in resistance to external forces. If strong wind is encountered, electrical wires of outdoor light strings are easy to knot and float, making it difficult to organize the light strings and affecting normal use of the light strings at the same time.

SUMMARY

To overcome shortcomings in the prior art, the present disclosure provides smart net light strings. By providing net-shaped light-emitting light strings, positioning stability of lamp beads is improved. The net-shaped lamp bead carrier is able to prevent the lamp beads from being displaced due to external forces, such as outdoor wind. Further, it avoids affecting normal decorative use of the lamp beads. The grid arrangement lamp beads facilitates decoration and beautification of the lamp beads on a lawn, a park, or a building surface, and greatly improves an ornamental nature of the lamp beads.

In order to solve the above problems in the prior art, the present disclosure provides following technical solutions. The present disclosure provides smart net light strings. The smart light strings comprise a limit guiding rail. A matched guiding rail is disposed on a top portion of the limit guiding rail. A top portion of the matched guiding rail is clamped with connecting plates. Locking rods are connected to the top portion of the matched guiding rail through threads. Positioning sleeves are inserted into an interior of the limit guiding rail, and the positioning sleeves are clamped with the limit guiding rail. A control unit is disposed in the interior of the limit guiding rail.

An electrical wire passes through an interior of each positioning sleeve. Lampshades are disposed on an outer surface of each electrical wire. An interior of each lampshade is filled with transparent glue. A lamp bead mounting groove is disposed on a surface of each lampshade. A connecting terminal is disposed on the surface of each lampshade. An LED lamp bead is installed in an interior of each connecting terminal. Each LED lamp bead extends from the connecting terminal. A silicone strip is installed in the interior of each connecting terminal. Each silicon strip runs through each connecting terminal.

Each silicone strip comprises a first mounting hole and a second mounting hole. Each first mounting hole is communicated with a corresponding second mounting hole. Wire grids are formed between the electrical wires and the silicone strips. Four corners of each wire grid are connected to a respective lampshade. Each wire grid shares one side with an adjacent wire grid.

The control unit comprises a linear voltage stabilizing chip; a model of the linear voltage stabilizing chip is HT7533 one end of an input pin of the linear voltage stabilizing chip is connected with a resistor. One end of the resistor is connected with a negative electrode of a first zener diode. An anode of the first zener diode is connected with a positive voltage.

In one embodiment, the connecting plate are symmetrically arranged with respect to a bisecting plane of the matched guiding rail. The connecting plates are arranged in an inverted T shape. One side of each connecting plate is sequentially fixedly connected with the matched guiding rail and the limit guiding rail through bolts.

In one embodiment, the locking rods run through the matched guiding rail. The locking rods are connected to a top surface and a bottom surface of the matched guiding rail through the threads. The number of the locking rods is two. A nut is disposed on a connection portion of each locking rod and the matched guiding rail.

In one embodiment, the positioning sleeves are hollow rubber cylindrical tubes. A length of each positioning sleeve is 10 cm. A distance between any two adjacent positioning sleeves is equal.

In one embodiment, the electrical wires are linearly arranged at equal intervals. A distance between any two adjacent electrical wires is equal to a distance between any two adjacent positioning sleeves. Each positioning sleeve matches a corresponding electrical wire. A through hole is on a bottom portion of each positioning sleeve. Each through hole is adapt to a cross section of the electrical wire.

In one embodiment, Each LED lamp bead is disposed in each lampshade. Each lampshade is rugby-shaped lampshade.

In one embodiment, each lampshade is ellipsoid-shaped lampshade.

In one embodiment, each of the silicone strips and each electrical wire are connected to each other through a corresponding connecting terminal and a corresponding lampshade.

In one embodiment, an input terminal of the linear voltage stabilizing chip is grounded through a second zener diode and a first capacitor. The second zener diode and the first capacitor are connected in parallel. An output pin of the linear voltage stabilizing chip is grounded through a second capacitor and a third capacitor. The second capacitor and the third capacitor are connected in parallel. A capacitance of the second capacitor is 0.1 μF.

By setting a voltage stabilizing circuit in the present disclosure, a PN junction of the first zener diode and the second zener diode are in a reverse breakdown state. Even if a current changes in a large range, a voltage value is kept basically constant, thereby maintaining a constant voltage of the circuit, which greatly improves stability of the control circuit. Meanwhile, by using the linear voltage stabilizing chip HT7533, a voltage stability of the voltage stabilizing circuit reaches 35V, which further improves the stability of the voltage stabilizing circuit and makes light-emitting effect of the LED lamp beads good.

The disclosure improves positioning stability of the LED lamp beads by arranging the net-shaped light-emitting light strings. The net-shaped LED lamp beads carrier prevent the LED lamp beads from displacing due to external forces such as outdoor wind and avoid affecting normal decoration and use of the LED lamp beads. The net-shaped layout of the LED lamp beads facilitates the decoration and beautification of the LED lamp beads on lawns, parks or building surfaces, and greatly enhances ornamental nature of the LED lamp beads.

In the present disclosure, by arranging rugby-shaped or ellipsoid-shaped lampshades, the curved lampshades form a rich visual expression effect, thereby enhancing an ornamental effect of the smart net light strings. Moreover, the lampshades are made of transparent plastic material, which are waterproof.

1—limit guiding rail; 2—matched guiding rail; 3—connecting plate; 4—locking rod; 5—positioning sleeve; 6—electrical wire; 7—lamp bead mounting groove; 8—connecting terminal; 9—LED lamp bead; 10—silicon strip; 11—first mounting hole; 12—second mounting hole; 13—wire grid.

DETAILED DESCRIPTION

In order to make technical means, creative features, objectives and effects of the present disclosure easy to understand, the following further describes the present disclosure in conjunction with specific embodiments, but the following embodiments are only optional embodiments of the present disclosure, not all of them. Based on the embodiments in the implementation manners, other examples obtained by those skilled in the art without creative work shall fall within the protection scope of the present disclosure. Experimental methods in the following examples are conventional methods unless otherwise specified. The materials and reagents used in the following examples can be obtained from commercial sources unless otherwise specified.

Embodiment

Figure 1:
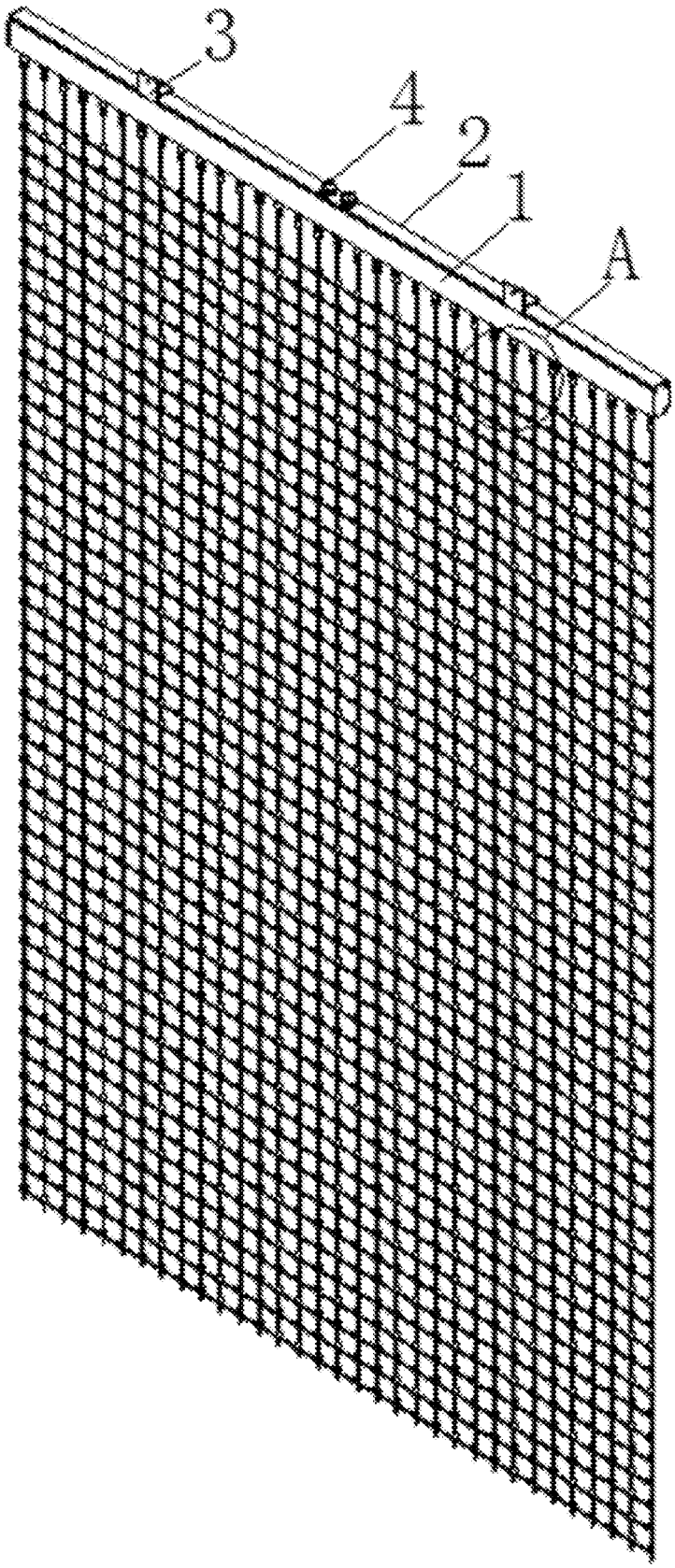
FIG. 1 is a schematic diagram showing an overall structure of smart net light strings of the present disclosure.
Figure 2:
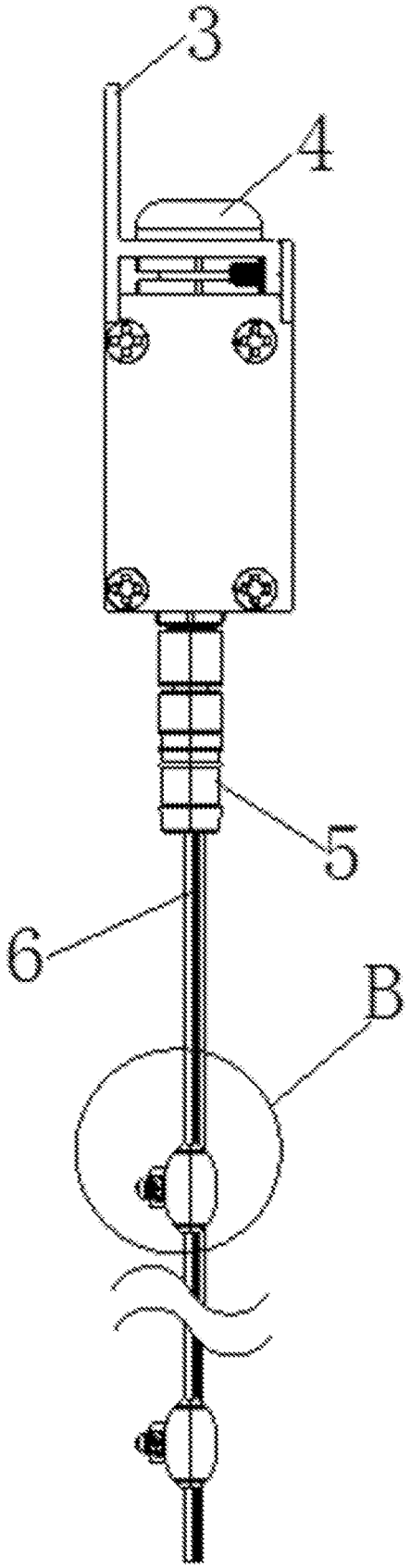
FIG. 2 is a side schematic diagram of the smart net light strings of the present disclosure.
Figure 3:
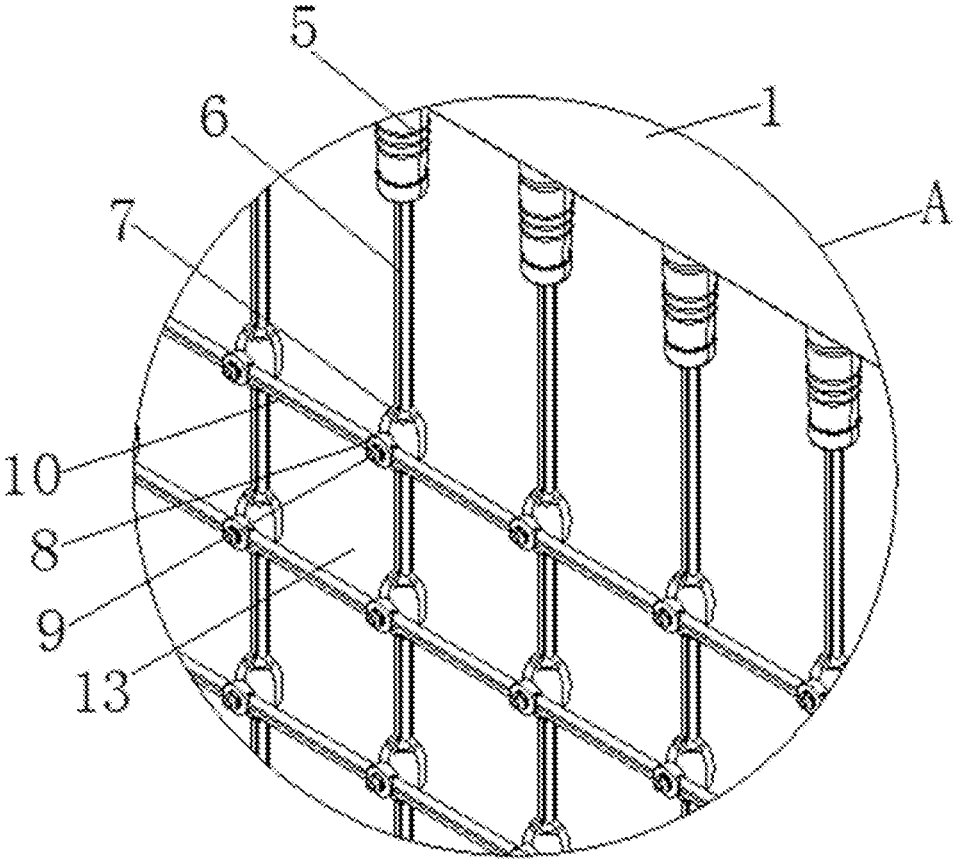
FIG. 3 is an enlarged view of portion A shown in FIG. 1.
Figure 4:
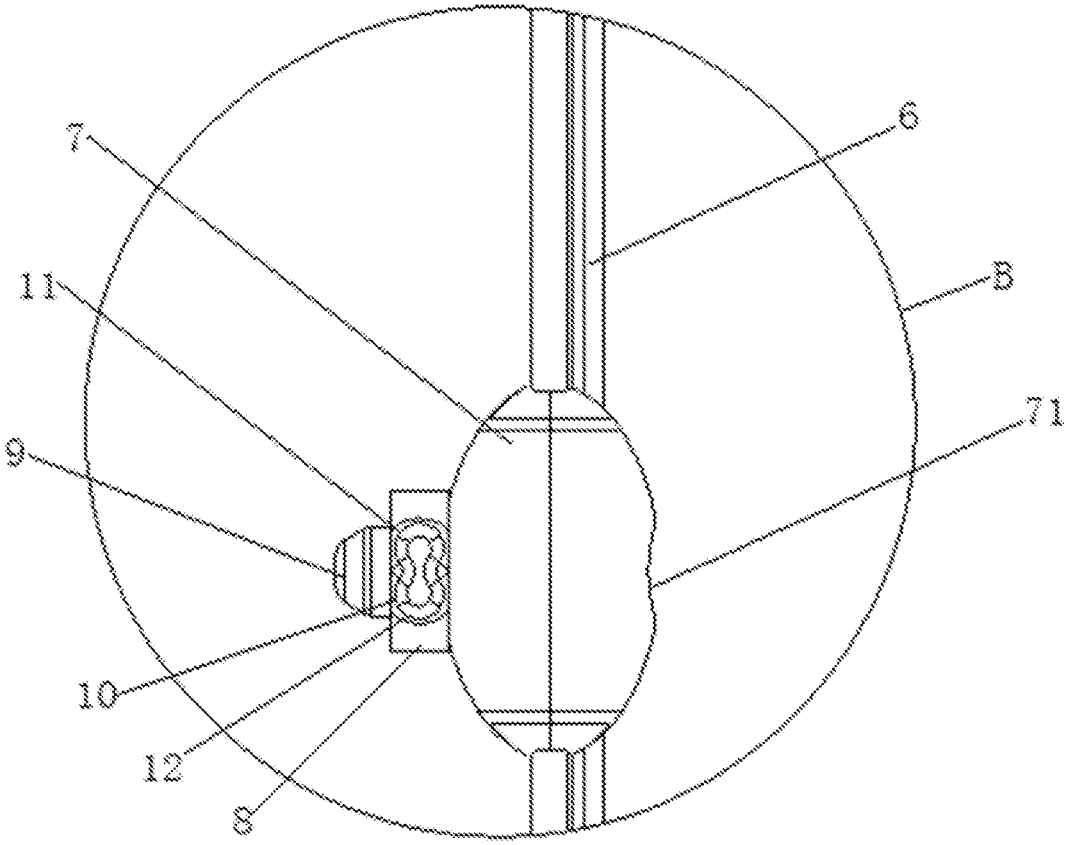
FIG. 4 is an enlarged view of portion B shown in FIG. 2.
Figure 5:
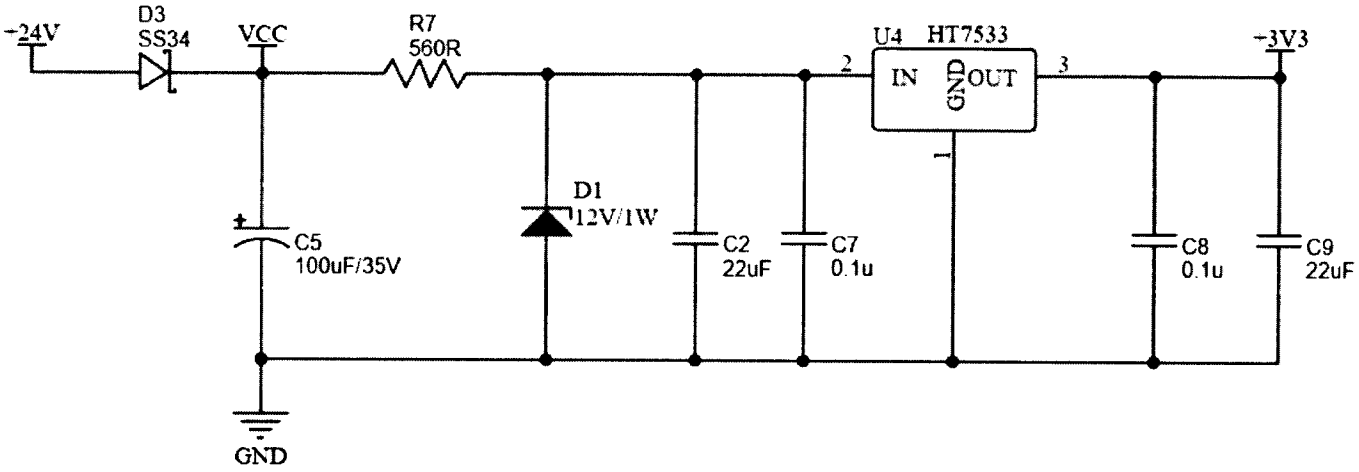
FIG. 5 is a schematic diagram of the voltage stabilizing circuit of the present disclosure.

As shown in FIGS. 1-5, the present disclosure provides smart net light strings. The smart light strings comprise a limit guiding rail 1. A matched guiding rail 2 is disposed on a top portion of the limit guiding rail 1. A top portion of the matched guiding rail is clamped with connecting plates 3. Locking rods 4 are connected to the top of the matched guiding rail 2 through threads. Positioning sleeves 5 are inserted into an interior of the limit guiding rail 1, and the positioning sleeves 5 are clamped with the limit guiding rail. A control unit is disposed in the interior of the limit guiding rail 1. An electrical wire 6 passes through an interior of each positioning sleeve. Lampshades 7 are disposed on an outer surface of each electrical wire 6. An interior of each lampshade 7 is filled with transparent glue. A lamp bead mounting groove 71 is disposed on a surface of each lampshade. A connecting terminal 8 is disposed on the surface of each lampshade 7. An LED lamp bead 9 is installed in an interior of each connecting terminal 8. Each LED lamp bead 9 extends from the connecting terminal 8. A silicone strip 10 is installed in the interior of each connecting terminal 8. Each silicon strip 10 runs through each connecting terminal 8. Each silicone strip 10 comprises a first mounting hole 11 and a second mounting hole 12. Each first mounting hole 11 is communicated with a corresponding second mounting hole 12. Wire grids 13 are formed between the electrical wires 6 and the silicone strips 10. Four corners of each wire grid 13 are connected to a respective lampshade 7. Each wire grid 13 shares one side with an adjacent wire grid 13. The control unit comprises a linear voltage stabilizing chip, and a model of the linear voltage stabilizing chip is HT7533 one end of an input pin of the linear voltage stabilizing chip is connected with a resistor R7. One end of the resistor R7 is connected with a negative electrode of a first zener diode D3. An anode of the first zener diode D3 is connected with a positive voltage.

In another embodiment, the connecting plate 3 are symmetrically arranged with respect to a bisecting plane of the matched guiding rail. The connecting plates 3 are arranged in an inverted T shape. One side of each connecting plate 3 is sequentially fixedly connected with the matched guiding rail 2 and the limit guiding rail 1 through bolts.

In another embodiment, the locking rods 4 run through the matched guiding rail 2. The locking rods 4 are connected to a top surface and a bottom surface of the matched guiding rail 2 through the threads. The number of the locking rods 4 is two. A nut is disposed on a connection portion of each locking rod 4 and the matched guiding rail 2. By setting the locking rod 4 passing through the matched guiding rail 2, the matched guiding rail 2 and the limit guiding rail 1 is fixed. By providing the detachable limit guiding rail 1 and the matched guiding rail 2, it is convenient for installation, replacement, maintenance, and disassembly of the guiding rails, thereby improving a convenience of the smart net light strings.

In another embodiment, the positioning sleeves 5 are hollow rubber cylindrical tubes. A length of each positioning sleeve 5 is 10 cm. A distance between any two adjacent positioning sleeves 5 is equal. A plurality of equal-spaced positioning sleeve 5 are provided, meanwhile, each positioning sleeve 5 is connected to one end of the electrical wire 6, so that an electrical connection end of each electrical wire 6 is protected. Further, positioning sleeves 5 are made of plastic material, so that the connection end of each electrical wire 6 is waterproof and dustproof, which extends a service life of the connection end of each electrical wires 6.

In another embodiment, the electrical wires 6 are linearly arranged at equal intervals. A distance between any two adjacent electrical wires 6 is equal to a distance between any two adjacent positioning sleeves 5. Each positioning sleeve 5 matches a corresponding electrical wire 6. A through hole is on a bottom portion of each positioning sleeve 5. Each through hole is adapt to a cross section of each electrical wire 6. By setting the distance of any two equal-spaced electrical wires 6 equal to the distance of any two equal-spaced LED lamp beads are connected to the equal distance, thereby forming the smart net light string that comprises the equal-spaced LED lamp beads, which ensures normal use of the screen, and facilitates the improvement of the screen.

In one embodiment, an LED lamp bead is disposed in each lampshade. Each lampshade 7 is rugby-shaped lampshade. By setting the rugby-shaped lampshade 7, the LED lamp beads are disposed inside the rugby-shaped lampshades 7.

In another embodiment, each lampshade 7 is ellipsoid-shaped lampshade.

In another embodiment, each of the silicone strips 10 and each electrical wire 6 are connected to each other through a corresponding connecting terminal 8 and a corresponding lampshade 7.

In another embodiment, an input terminal of the linear voltage stabilizing chip is grounded through a second zener diode D1 and a first capacitor C7. The second zener diode D1 and the first capacitor C7 are connected in parallel. An output pin of the linear voltage stabilizing chip is grounded through a second capacitor C8 and a third capacitor C9. The second capacitor C8 and the third capacitor C9 are connected in parallel. A capacitance of the second capacitor C8 is 0.1 μF.

A working principle of the present disclosure is as follow: When in use, the limit guiding rail 1 is clamped with the matched guiding rail 2, and by fixedly connecting the limit guiding rail 1 with the matched guiding rail 2 through the locking rods 4 and the connecting plates 3, the smart net light strings are fixed to the limit guide rail 1 and the adapter guide 2. Each electrical wire 6 passes through the corresponding positioning sleeve 5 and the electrical wire 6, the LED lamp beads are disposed on the outer surface of the electrical wires 6 through the lampshades 7. The electrical wires 6 intersect the silicone strips 10, while the LED lamp beads are disposed on the silicone strips 10 through the connection terminals. Thus, double-sided light-emitting smart net light strings are formed. By setting net-shaped light-emitting light strings, positioning stability of the LED lamp beads during using is improved. The net-shaped lamp carrier prevents the LED lamp beads from being displaced due to outdoor wind and avoids affecting a normal decoration effect of the LED lamp beads. Meanwhile, the voltage stabilizing circuit is set in the control unit and the linear voltage stabilizing using the model HT7533 is provided. By setting a regulated voltage circuit, it can be reversed by the regulated diode D3 and the regulator diode D1. Even if the current varies in a wide range, it can maintain the voltage substantially constant, thereby maintaining a constant circuit voltage. By setting the voltage stabilizing circuit in the present disclosure, the PN junction of the first zener diode D3 and the second zener diode D1 are in a reverse breakdown state. Even if an current changes in a large range, a voltage value is kept basically constant, thereby maintaining a constant voltage of the circuit, In the present disclosure, unless otherwise expressly stated and defined, a first feature is disposed "upper" or "lower" a second feature means that the first feature may direct contact the second feature or the first features are connected with the second feature through other features. Moreover, the first feature disposed "above", "over" or "on" the second feature means that the first feature may disposed directly above or obliquely above the second feature, or only means that a level of the first feature is higher than that of the second feature. The first feature is disposed "beneath", "below" and "under" the second feature means that the first feature is directly below or obliquely below the second feature, or only means that the level of the first feature level is less than that of the second feature.

Basic principles, main features, and advantages of the present disclosure are shown and described above. Those skilled in the field will be appreciated that the present disclosure is not limited by the above-described embodiments. The optional embodiments of the present disclosure are not intended to limit the scope of the present disclosure, and various changes and modifications that made without departing from the spirit and scope of the present disclosure should all fall within the scope of the present disclosure.

What is claimed is:

1. Smart net light strings, comprising:

a limit guiding rail (1), wherein a matched guiding rail (2) is disposed on a top portion of the limit guiding rail (1); a top portion of the matched guiding rail (2) is clamped with connecting plates (3); locking rods (4) are connected to the top of the matched guiding rail (2) through threads, positioning sleeves (5) are inserted into an interior of the limit guiding rail (1), and the positioning sleeves (5) are clamped with the limit guiding rail (1); a control unit is disposed in the interior of the limit guiding rail (1);

wherein an electrical wire (6) passes through an interior of each positioning sleeve (5), lampshades (7) are disposed on an outer surface of each electrical wire (6); an interior of each lampshade (7) is filled with transparent glue; a lamp bead mounting groove (71) is disposed on a surface of each lampshade (7); a connecting terminal (8) is disposed on the surface of each lampshade (7); an LED lamp bead (9) is installed in an interior of each connecting terminal (8); each LED lamp bead (9) extends from the connecting terminal (8); a silicone strip (10) is installed in the interior of each connecting terminal (8); each silicon strip (10) runs through each connecting terminal (8);

wherein each silicone strip (10) comprises a first mounting hole (11) and a second mounting hole (12), each first mounting hole (11) is communicated with a corresponding second mounting hole (12); wire grids (13) are formed between the electrical wires (6) and the silicone strips (10); four corners of each wire grid (13) are connected to a respective lampshade (7); each wire grid (13) shares one side with an adjacent wire grid (13);

wherein the control unit comprises a linear voltage stabilizing chip, a model of the linear voltage stabilizing chip is HT7533; one end of an input pin of the linear voltage stabilizing chip is connected with a resistor (R7); one end of the resistor (R7) is connected with a negative electrode of a first zener diode (D3); an anode of the first zener diode (D3) is connected with a positive voltage.

2. The smart net light strings according to claim 1, wherein the connecting plate (3) are symmetrically arranged with respect to a bisecting plane of the matched guiding rail (2); the connecting plates (3) are arranged in an inverted T shape; one side of each connecting plate (3) is sequentially fixedly connected with the matched guiding rail (2) and the limit guiding rail (1) through bolts.

3. The smart net light strings according to claim 1, wherein the locking rods (4) run through the matched guiding rail (2); the locking rods (4) are connected to a top surface and a bottom surface of the matched guiding rail (2) through the threads; the number of the locking rods (4) is two; a nut is disposed on a connection portion of each locking rod (4) and the matched guiding rail (2).

4. The smart net light strings according to claim 1, wherein the positioning sleeves (5) are hollow rubber cylindrical tubes; a length of each positioning sleeve (5) is 10 cm; a distance between any two adjacent positioning sleeves (5) is equal.

5. The smart net light strings according to claim 1, wherein the electrical wires (6) are linearly arranged at equal intervals, a distance between any two adjacent electrical wires (6) is equal to a distance between any two adjacent positioning sleeves (5), each positioning sleeve (5) matches a corresponding electrical wire (6); and a through hole is on a bottom portion of each positioning sleeve (5); each through hole is adapt to a cross section of the electrical wire (6).

6. The smart net light strings according to claim 1, wherein each LED lamp bead (9) is disposed in each lampshade (7); each lampshade (7) is rugby-shaped.

7. The smart net light strings according to claim 1, wherein each lampshade (7) is ellipsoid-shaped.

8. The smart net light strings according to claim 1, wherein each of the silicone strips (10) and each electrical wire (6) are connected to each other through a corresponding connecting terminal (8) and a corresponding lampshade (7).

9. The smart net light strings according to claim 8, wherein an input terminal of the linear voltage stabilizing chip is grounded through a second zener diode (D1) and a first capacitor (C7); the second zener diode (D1) and the first capacitor (C7) are connected in parallel; an output pin of the linear voltage stabilizing chip is grounded through a second capacitor (C8) and a third capacitor (C9); the second capacitor (C8) and the third capacitor (C9) are connected in parallel; a capacitance of the second capacitor (C8) is 0.1 μF.

* * * * *